United States Patent [19]

Forss et al.

[11] 4,230,950

[45] Oct. 28, 1980

[54] ELECTRO-OPTIC SMOKE DETECTOR

[75] Inventors: John A. Forss, Excelsior; Tzuo-Chang Lee, Bloomington, both of Minn.

[73] Assignee: Honeywell Inc., Minneapolis, Minn.

[21] Appl. No.: 39,467

[22] Filed: May 16, 1979

[51] Int. Cl.[3] ..... G08B 17/10

[52] U.S. Cl. ..... 250/574; 340/630

[58] Field of Search ..... 250/574; 340/630; 356/338, 438

[56] References Cited

U.S. PATENT DOCUMENTS 3,524,707 8/1970 Hanson et al. ..... 250/574 X

*Primary Examiner*—David C. Nelms
*Assistant Examiner*—Darwin R. Hostetter
*Attorney, Agent, or Firm*—Omund R. Dahle

[57] ABSTRACT

An electro-optic smoke detector is described which has an improved smoke chamber and detector construction to enhance the detector sensitivity in general and its response to small smoke particles in particular.

8 Claims, 2 Drawing Figures

ELECTRO-OPTIC SMOKE DETECTOR

BACKGROUND AND SUMMARY OF THE INVENTION

This invention relates generally to apparatus used in conjunction with fire detection and alarm systems. More particularly it is directed to an electro-optic device designed to detect and annunciate the presence of smoke in the air in or moving through the device. To increase the sensitivity of the device to small smoke particles the components of this device are arranged so that both light which is forward scattered and light which is back scattered are efficiently collected.

One of the limitations of optical smoke detectors has been that while they are extremely sensitive to the presence of large smoke particles they have been less sensitive to small smoke particles. By novel structural arrangements in the smoke chamber we have substantially improved the sensitivity of the optical smoke detector to small smoke particles. Small smoke particles are herein defined as those particles having a diameter (D) less than the wavelength of the light being used. The small smoke particles tend to be generated in flash fires or rapidly burning fires in contrast to smouldering fires which tend to result in large smoke particles to be sensed.

DESCRIPTION

Figure 1:
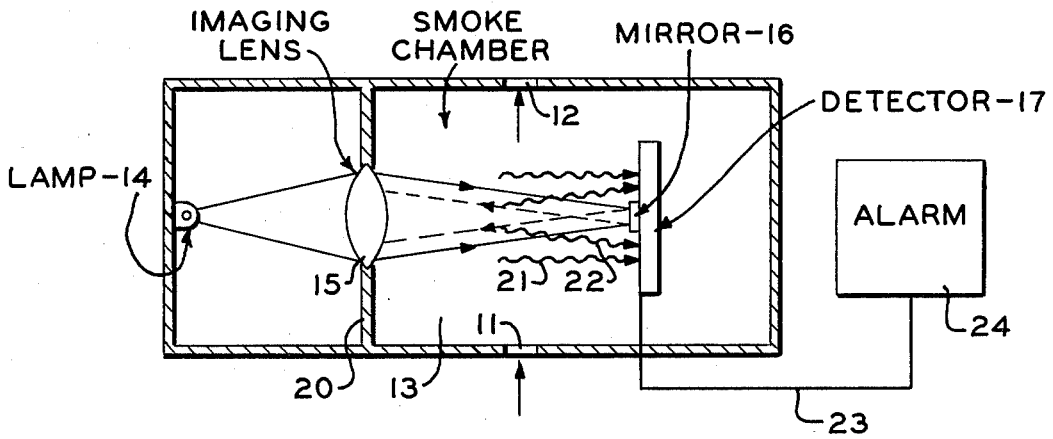
FIG. 1 is a diagrammatic representation of the improved smoke detector chamber showing the major components and their relationship.

Referring now to the drawings there is illustrated in FIG. 1 a cross section view of the smoke detector chamber. An exterior casing 10 has openings 11 and 12 in its lower and upper portions respectively for allowing air to flow through the sensing chamber 13. A source of radiant energy 14, in the visible, IR or UV spectrum, and hereafter called light, is transmitted through an imaging lens 15 into chamber 13 to be focused or directed towards a small mirror 16 which is coated on the center of a relatively large area detector 17. The source, lens and detector are all mounted within the casing 10, the mounting 20 for the lens 15 providing an opaque divider to allow light from the source 14 to reach the chamber 13 only by way of the imaging lens 15. In one embodiment the large area detector 17 is a photodiode model CLD31, by Clairex Corporation of New York, N.Y. This photodiode is designed to operate in the photovoltaic mode and has an active area of about 22 $mm^2$. Its peak sensitivity is in the wavelength of 0.9–1.0 microns and is well suited for use with an infrared LED as the source 14. In this embodiment a gallium arsenide LED may be used, for example.

The transmitted light from source 14 is imaged by the imaging lens 15 onto the mirror 16 located in the middle of the detector 17. In the absence of smoke there is no light scatter and the transmitted light from the source does not fall on the detector 17 but falls entirely on the mirror and thus all of the light is reflected. When smoke is present the smoke particles cause a forward scatter 21 of the transmitted light which scattered light is collected by the detector 17. The arrangement shown allows high efficiency collection of forward scattered light partly because shallow angle scattering is collected by this novel chamber geometry.

Figure 2:
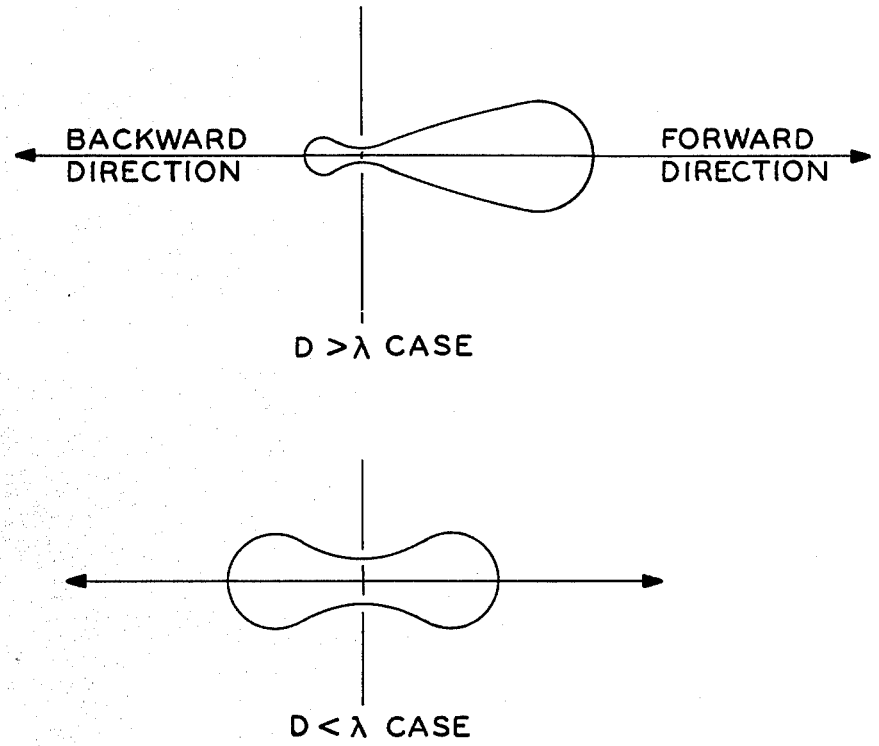
FIG. 2 is a graphical representation of forward and backward light scatter in a smoke detector vs. smoke particle size.

The graphs of FIG. 2 show the scattered radiation pattern which exists due both to large ($D>\lambda$) and small ($D<\lambda$) smoke particles; and that for large smoke particles, e.g. the diameter D of the smoke particles is larger than the wavelength $\lambda$ of the light from source 14, the light scatter from the particles is predominantly forward scatter with very little backward scatter, and also that for small smoke particles, e.g. the diameter of smoke particles smaller than $\lambda$, the back scatter increases and is substantially equal to the forward scatter.

The use of the mirror 16 which reflects the light back generally towards the source makes is possible to also collect the back scattered light 22 of the reflected light just as effectively as forward scattered light of the transmitted light is collected. This efficient collection of the back scattered light is significant when smoke particles are small and provides an optical smoke detector with enhanced sensitivity for the detection of small particle smoke.

The electrical output of the detector 17 is electrically connected 23 to an alarm circuit 24. Detector 17 in response to light reflected from the smoke suspended within the chamber area 13 causes an electrical current to flow to alarm circuit 24. The alarm circuit may be an amplifier-relay combination, which when the signal from the detector reaches a predetermined magnitude, closes a circuit to activate an alarm device. In smoke detectors which are designed for easy flow of air through the smoke chamber, the ambient light surrounding the detector may not be completely excluded from the detector. In these detectors to eliminate any effect of ambient steady state light, the smoke detector apparatus generally includes a pulse light source and a pulse sensitive detection circuit which may, if desired, be synchronized to the pulse light source. This pulse responsive type smoke detector circuit is less sensitive to ambient light conditions.

The embodiments of the invention in which an exclusive property or right is claimed are defined as follows:

1. Optical smoke detector apparatus comprising:

a smoke sensing chamber having air inlet and outlet means;

an optical sensor in said chamber having a face comprising a light receiving portion and a light reflecting portion, said light receiving portion being of a relatively large area with respect to said light reflecting portion;

light source means in said apparatus;

means directing the light from said source substantially onto said light reflecting portion and minimally onto said light receiving portion, whereby the light directed on said light reflecting portion is reflected generally back towards said source without falling on said light receiving portion;

and whereby in the presence of smoke in said chamber light is scattered thereby, and falls on said light receiving portion to indicate the presence of said smoke.

2. The apparatus in accordance with claim 1 wherein, said optical sensor face is substantially planar, with said light reflecting portion taking the form of a small mirror in the middle of said light receiving portion.

3. The apparatus in accordance with claim 1 wherein, said light source means is an infrared source and said optical sensor light receiving portion is sensitive to the infrared.

4. The apparatus in accordance with claim 1 wherein, said means directing the light is a focussing lens.

5. An improved smoke sensing chamber for an optical smoke detector apparatus comprising:

a smoke sensing chamber;

light source means in said apparatus;

mirror means in said chamber;

light detector means surrounding said mirror means in said chamber;

means focussing the light from said source onto said mirror means and not onto said surrounding light detector means, whereby the light directed on said mirror means is reflected generally back toward said source without falling on said light detector means;

and whereby in the presence of smoke in said chamber the focussed light and the reflected light is scattered by the smoke particles and the scattered light falls on the light detector means to indicate the presence of said smoke.

6. The apparatus in accordance with claim 5 wherein, said light source means is an infrared source.

7. The apparatus in accordance with claim 6 wherein, said infrared source is a gallium arsenide light emitting diode (LED).

8. The apparatus in accordance with claim 6 wherein, said light detector means is sensitive to the infrared source.

* * * * *